US007096698B2

(12) United States Patent
Walsh, III et al.

(10) Patent No.: US 7,096,698 B2
(45) Date of Patent: Aug. 29, 2006

(54) OVERRIDE ASSEMBLY FOR DOOR LOCK SYSTEMS HAVING A CLUTCH MECHANISM

(75) Inventors: John E. Walsh, III, Wallingford, CT (US); Vu Dinh Nguyen, West Hartford, CT (US)

(73) Assignee: Harrow Products LLC, Montvale, NJ (US)

( * ) Notice: Subject to any disclaimer, the term of this patent is extended or adjusted under 35 U.S.C. 154(b) by 96 days.

(21) Appl. No.: 10/386,035

(22) Filed: Mar. 11, 2003

(65) Prior Publication Data

US 2004/0177663 A1 Sep. 16, 2004

(51) Int. Cl.
*E05B 55/04* (2006.01)

(52) U.S. Cl. ..... 70/472; 70/149; 70/277; 70/283

(58) Field of Classification Search ..... 70/472, 70/149, 277–283, 218, 219, 222–224
See application file for complete search history.

(56) References Cited

U.S. PATENT DOCUMENTS 4,148,092 A * 4/1979 Martin ..... 361/172
4,770,012 A * 9/1988 Johansson et al. ..... 70/278.1
4,802,353 A * 2/1989 Corder et al. ..... 70/277
4,820,330 A * 4/1989 Lin ..... 70/277
4,995,248 A * 2/1991 Liu ..... 70/107
5,104,594 A 4/1992 Hillemeier et al.
5,136,870 A * 8/1992 Gartner et al. ..... 70/277
5,473,236 A 12/1995 Frolov
5,475,996 A * 12/1995 Chen ..... 70/279.1
5,517,176 A 5/1996 Lavelle et al.
5,537,103 A 7/1996 Lavelle et al.
5,608,298 A 3/1997 Frolov et al.
5,640,863 A * 6/1997 Frolov ..... 70/283
5,641,187 A 6/1997 Frolov
5,715,715 A * 2/1998 Nunez ..... 70/283
5,735,559 A 4/1998 Frolov
5,923,264 A 7/1999 Lavelle et al.
5,987,945 A * 11/1999 Ruano Aramburu ..... 70/277
5,988,708 A 11/1999 Frolov et al.
5,992,195 A * 11/1999 Huang et al. ..... 70/472
6,032,985 A 3/2000 Cutter
6,045,169 A 4/2000 Frolov
6,053,019 A * 4/2000 Wiik et al. ..... 70/283
6,062,612 A * 5/2000 Lin ..... 292/144
6,076,870 A 6/2000 Frolov
6,079,240 A 6/2000 Shvarts
6,082,791 A 7/2000 Frolov et al.
6,104,594 A 8/2000 Frolov et al.
6,145,353 A 11/2000 Doucet (Continued)

FOREIGN PATENT DOCUMENTS

EP 0 709 535 5/1996

(Continued)

*Primary Examiner*—Suzanne Dino Barrett
(74) *Attorney, Agent, or Firm*—Michael Best & Friedrich LLP

(57) ABSTRACT

A lock system for a door. The lock system includes a clutch mechanism and a lockset with a lockable latch and actuator for operating the latch. The clutch mechanism includes an input cam, an output cam, and an engagement pin having an axis and being dimensioned and configured for axial movement between a first position, in which the engagement pin engages both the input and output cams so that the input and output cams rotate synchronously, and a second position, which allows independent rotational movement of the input cam and the output cam.

3 Claims, 8 Drawing Sheets

U.S. PATENT DOCUMENTS

| | | | | |
|---|---|---|---|---|
| 6,178,794 | B1 * | 1/2001 | Eller et al. | 70/472 |
| 6,218,955 | B1 | 4/2001 | Conklin | |
| 6,286,347 | B1 * | 9/2001 | Frolov | 70/472 |
| 6,301,942 | B1 | 10/2001 | Shvarts | |
| 6,330,817 | B1 | 12/2001 | Frolov | |
| 6,354,121 | B1 | 3/2002 | Frolov | |
| 6,363,762 | B1 * | 4/2002 | Kueng | 70/278.3 |
| 6,386,597 | B1 | 5/2002 | Walsh, III | |
| 6,390,514 | B1 | 5/2002 | Frolov | |
| 6,487,884 | B1 * | 12/2002 | Constantinou | 70/277 |
| 6,540,274 | B1 * | 4/2003 | Bates et al. | 292/336.5 |
| 6,543,264 | B1 * | 4/2003 | Frolov | 70/222 |
| 6,565,130 | B1 | 5/2003 | Walsh, III | |
| 6,568,231 | B1 * | 5/2003 | Huang | 70/468 |
| 6,584,818 | B1 * | 7/2003 | Bates et al. | 70/432 |
| 6,611,414 | B1 | 8/2003 | Lavelle et al. | |
| D479,682 | S | 9/2003 | Frolov et al. | |
| 6,689,972 | B1 | 2/2004 | Frolov et al. | |
| 6,714,118 | B1 | 3/2004 | Frolov et al. | |
| 2003/0071715 | A1 | 4/2003 | Lavelle et al. | |
| 2003/0132829 | A1 | 7/2003 | Frolov et al. | |

FOREIGN PATENT DOCUMENTS

| | | |
|---|---|---|
| EP | 1 154 105 | 11/2001 |

* cited by examiner

OVERRIDE ASSEMBLY FOR DOOR LOCK SYSTEMS HAVING A CLUTCH MECHANISM

FIELD OF THE INVENTION

The present invention relates generally to door mounted security systems and, more particularly, to a lock system that can be employed with entry control devices to control access through a door.

BACKGROUND OF THE INVENTION

Entry control devices are generally mounted on a door and/or a doorframe and operate to limit access through the door. Some conventional entry control devices include a clutch mechanism that selectively couples a bolt and a handle in response to an electronic input, which may be provided by a keypad, a contact activatable chip, a card reader, and other similar input devices. In some cases, entry control devices, and particularly electronically controlled entry devices, are inoperable during power failures and/or when dedicated power sources fail. Additionally, when electrical power is unavailable, conventional electronically controlled entry control devices generally remain in a locked position, restricting access through the door.

SUMMARY OF THE INVENTION

The present invention provides a lock system for securing a door and a doorframe. In one construction, the lock system includes a clutch mechanism and a lockset with a lockable latch and an actuator for operating the latch. The clutch mechanism includes an input cam, an output cam, and an engagement pin that is dimensioned and configured for axial movement between first and second positions. In the first position, the engagement pin engages both the input and the output cams to couple the input and output cams so that they rotate synchronously, allowing the door to be opened. In the second position, the engagement pin does not engage both the cams and thereby allows independent rotational movement of the input cam and the output cam so that pivoting of the exterior latch lever does not retract the latch.

In other constructions, an arcuate carriage cooperates with the engagement pin to move the engagement pin between the first position and the second position. A frame biases the carriage towards a third position, in which the frame maintains the engagement pin in the first position. A removable interchangeable core, when installed, blocks the frame moving the carriage toward the third position. The core, when removed, allows the frame to move the carriage toward the third position, resulting in movement of the engagement pin toward the first position and permitting retraction of the latch.

Other features and advantages of the invention will become apparent to those skilled in the art upon review of the following detailed description, claims, and drawings.

BRIEF DESCRIPTION OF THE DRAWINGS

The present invention is further described with reference to the accompanying drawings, which show constructions of the present invention. However, it should be noted that the invention as disclosed in the accompanying drawings is illustrated by way of example only. The various elements and combinations of elements described below and illustrated in the drawings can be arranged and organized differently to result in constructions which are still within the spirit and scope of the present invention.

In the drawings, wherein like reference numerals indicate like parts.

DETAILED DESCRIPTION

The terms "first", "second", "upward", "downward", "horizontal", and "vertical" are used herein and in the appended claims for description only and are not intended to imply any particular orientation, order, or importance.

FIGS. 1–4 illustrate a lock system 10 according to a first construction of the present invention. The lock system 10 is mountable on an exterior side of a door (not shown) and is operable to limit access through the door and the associated doorframe (not shown). Also, in some constructions (not shown), the lock system 10 can be hardwired.

As described in greater detail below, the lock system 10 includes an electronically operated clutch mechanism having an override assembly. In some constructions of the present invention, some of the elements of the lock system 10 function in a manner that is similar to the apparatuses described in U.S. Pat. No. 6,286,347, issued Sep. 11, 2001, entitled "CLUTCH MECHANISM WITH MOVEABLE INJECTOR RETAINER WALL FOR DOOR LOCK SYSTEM" and U.S. Pat. No. 5,640,863, issued Jun. 24, 1997, entitled "CLUTCH MECHANISM FOR DOOR LOCK SYSTEM that are hereby incorporated by reference. Additionally, persons of ordinary skill in the art will recognize the advantages inherent in clutch operated mechanisms, which can operate in combination with lever handles that comply with the regulatory requirements of the Americans with Disabilities Act.

Figure 1:
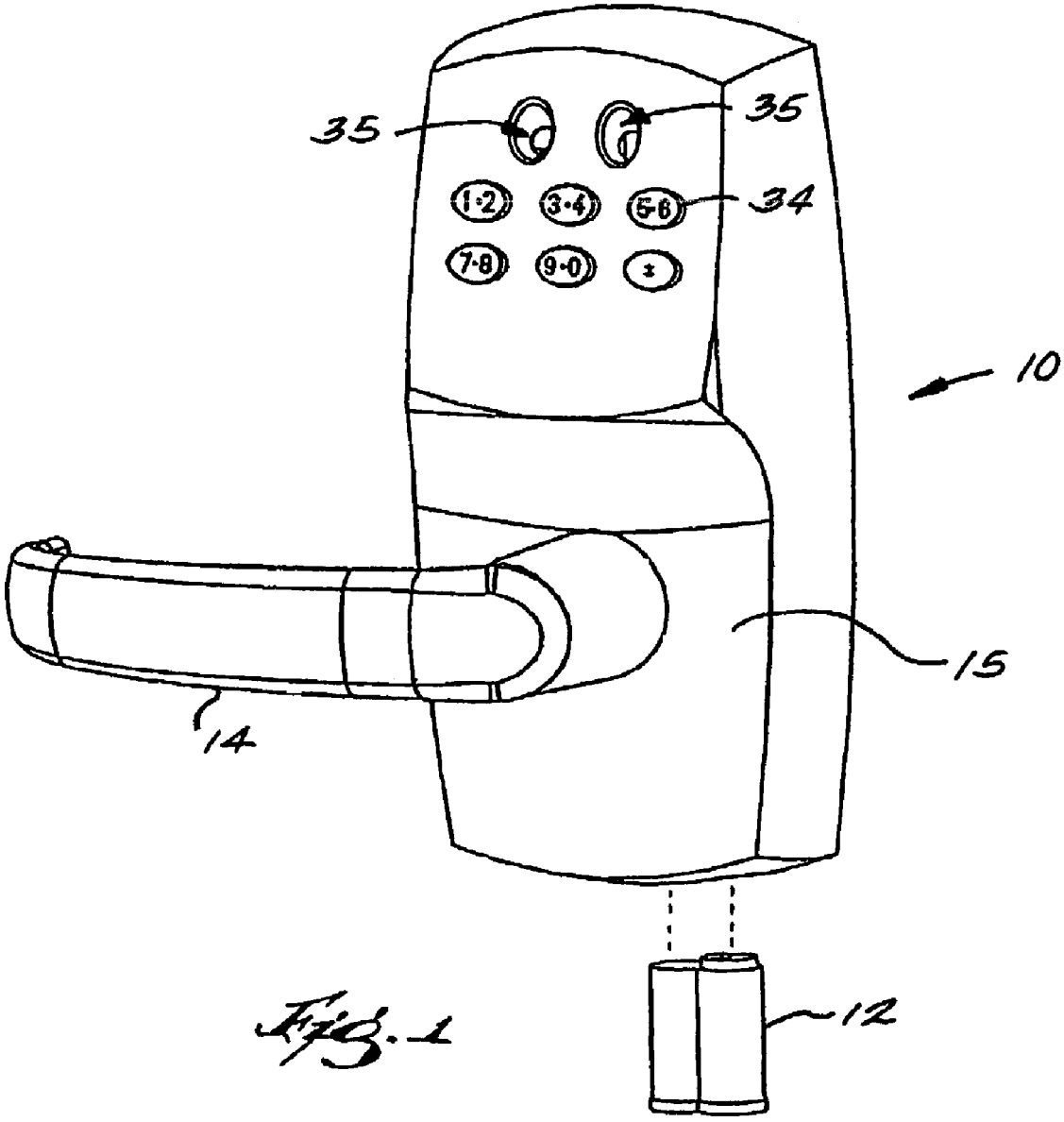
FIG. 1 is a perspective view of a first construction of a lock system embodying aspects of the present invention.
Figure 2:
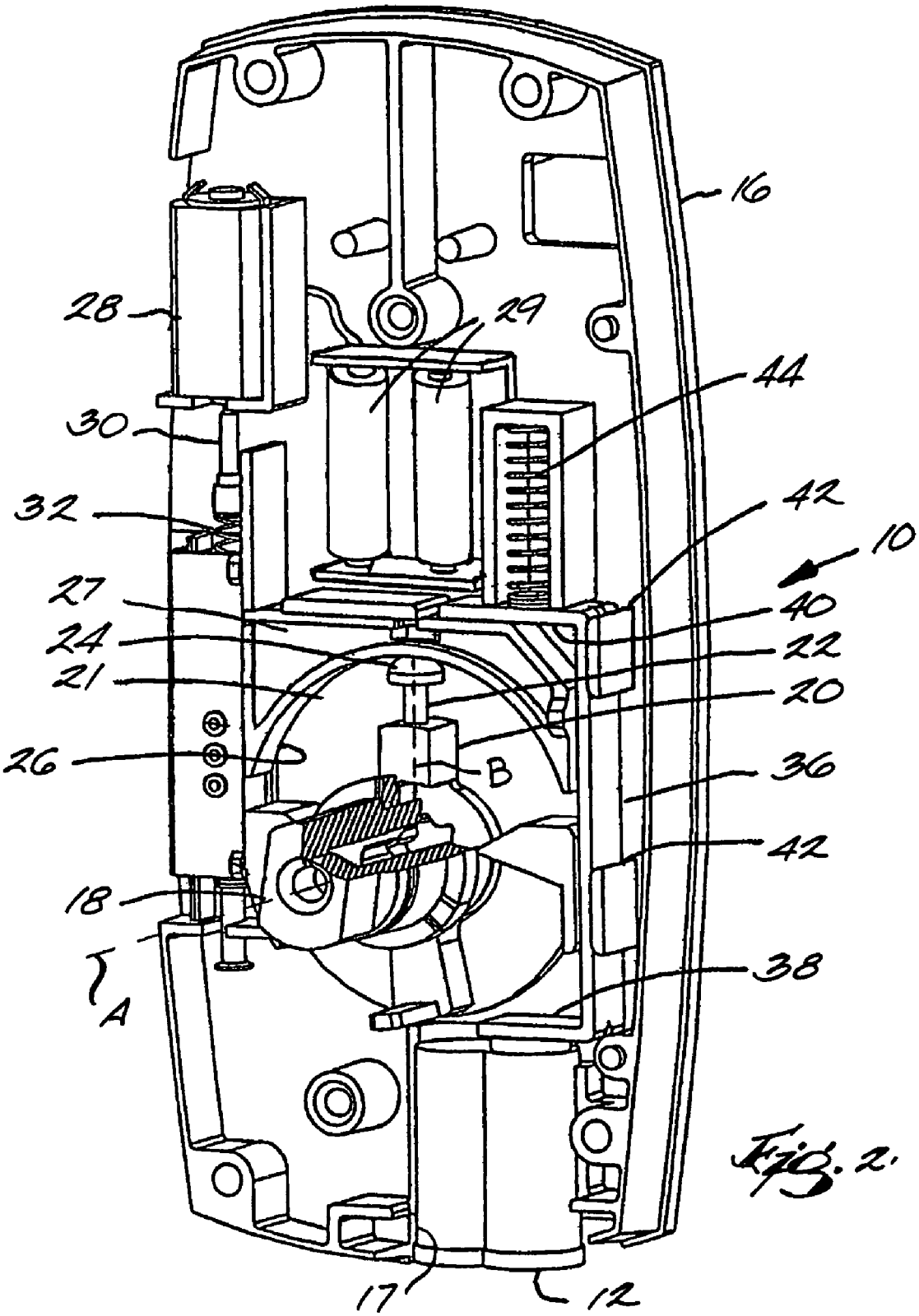
FIG. 2 is a perspective view of the back side of the lock system shown in FIG. 1 with the outer housing removed and the lock system in a locked position.
Figure 3:
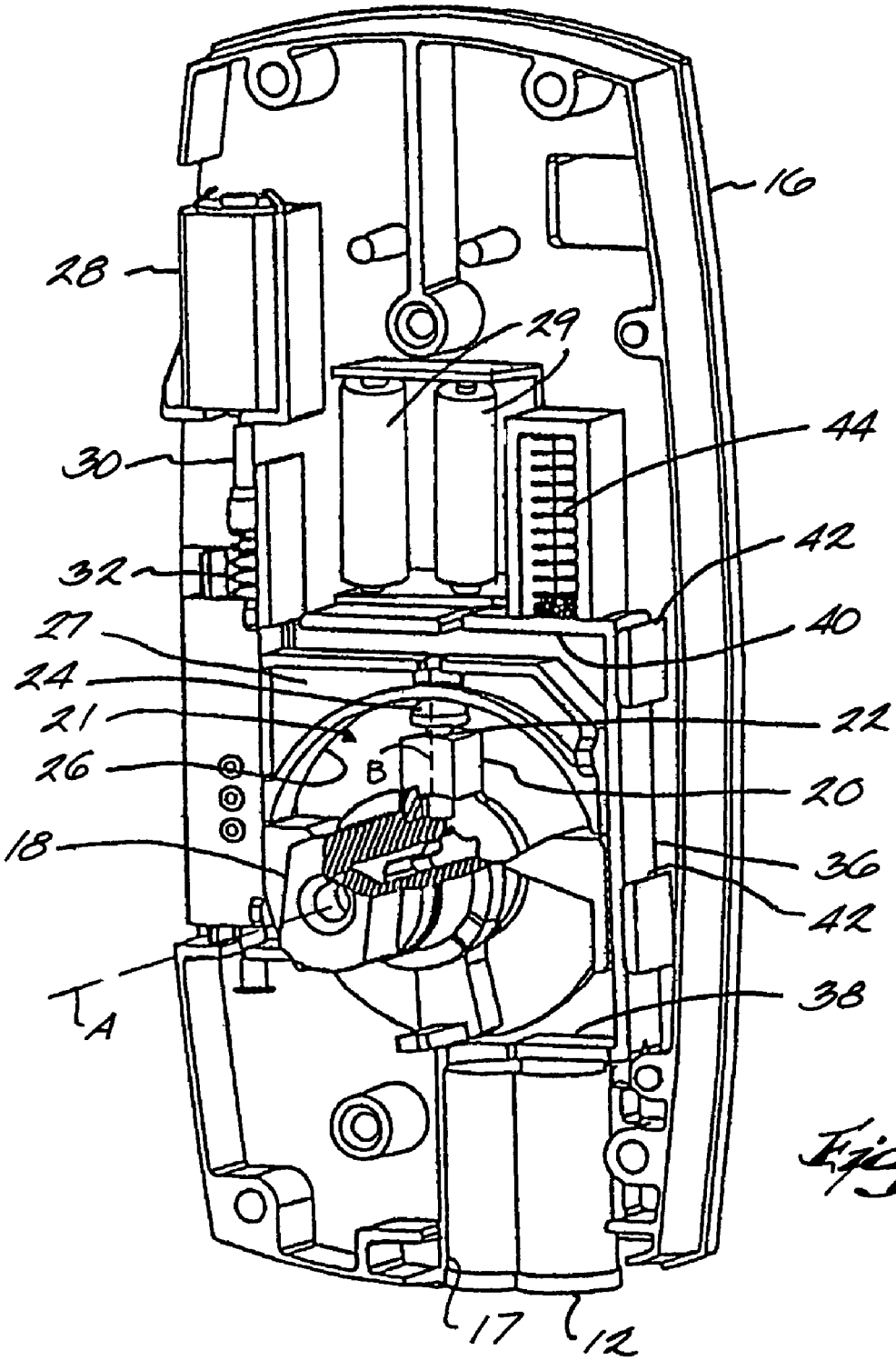
FIG. 3 is a perspective view of the back side of the lock system shown in FIG. 1 with the outer housing removed and the lock system in an unlocked position.
Figure 4:
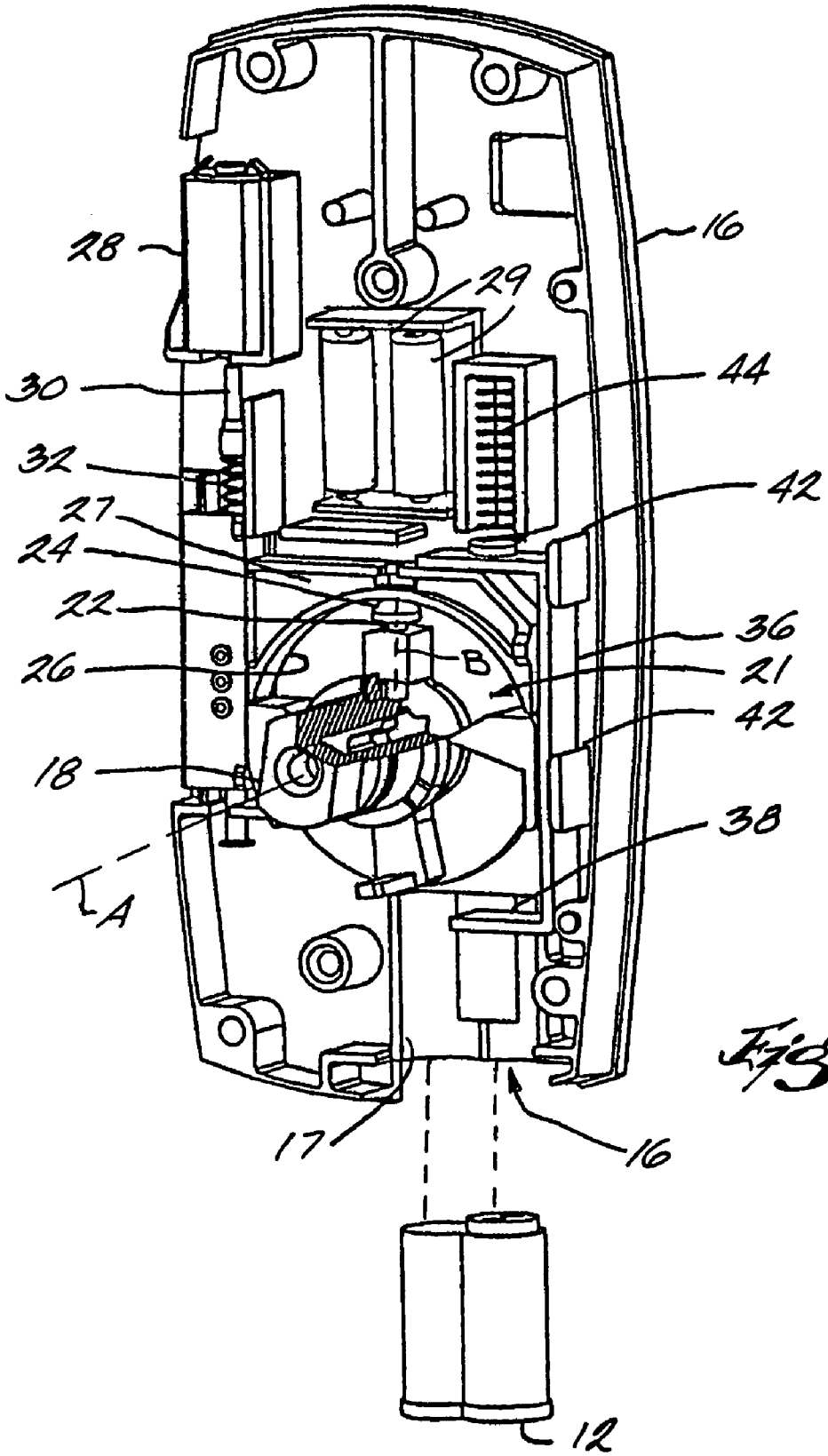
FIG. 4 is a perspective view of the back side of the lock system shown in FIG. 1 with the outer housing removed and a lock core removed from the lock system.
Figure 5:
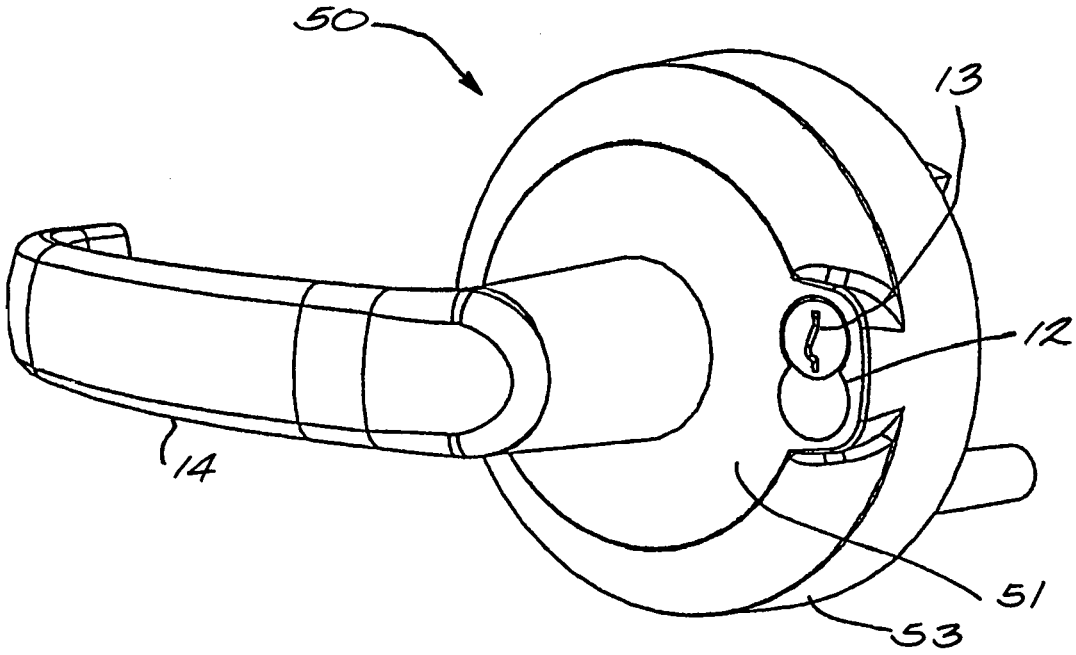
FIG. 5 is a perspective view of a second construction of the lock system of the present invention.
Figure 6:
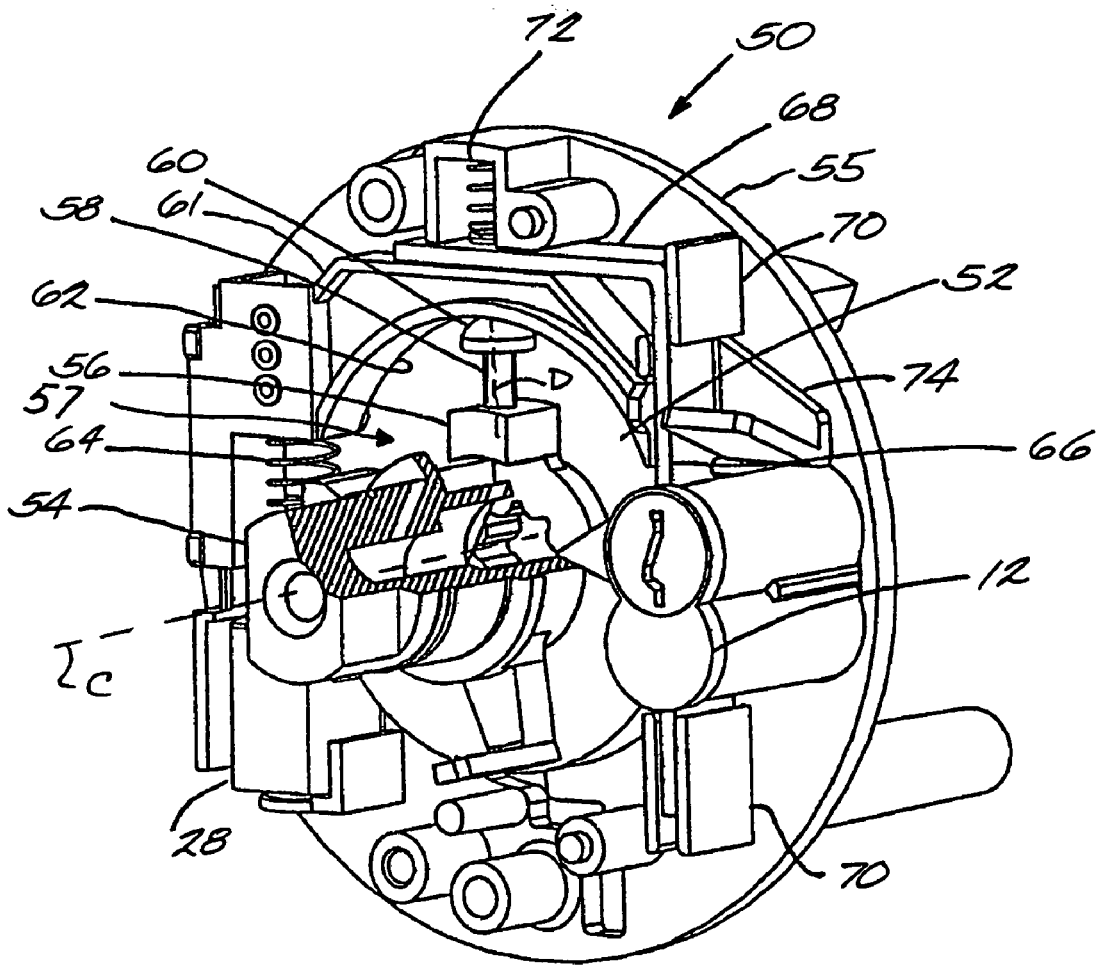
FIG. 6 is a perspective view of the lock system shown in FIG. 5 with the outer housing removed and the lock system in a locked position.
Figure 7:
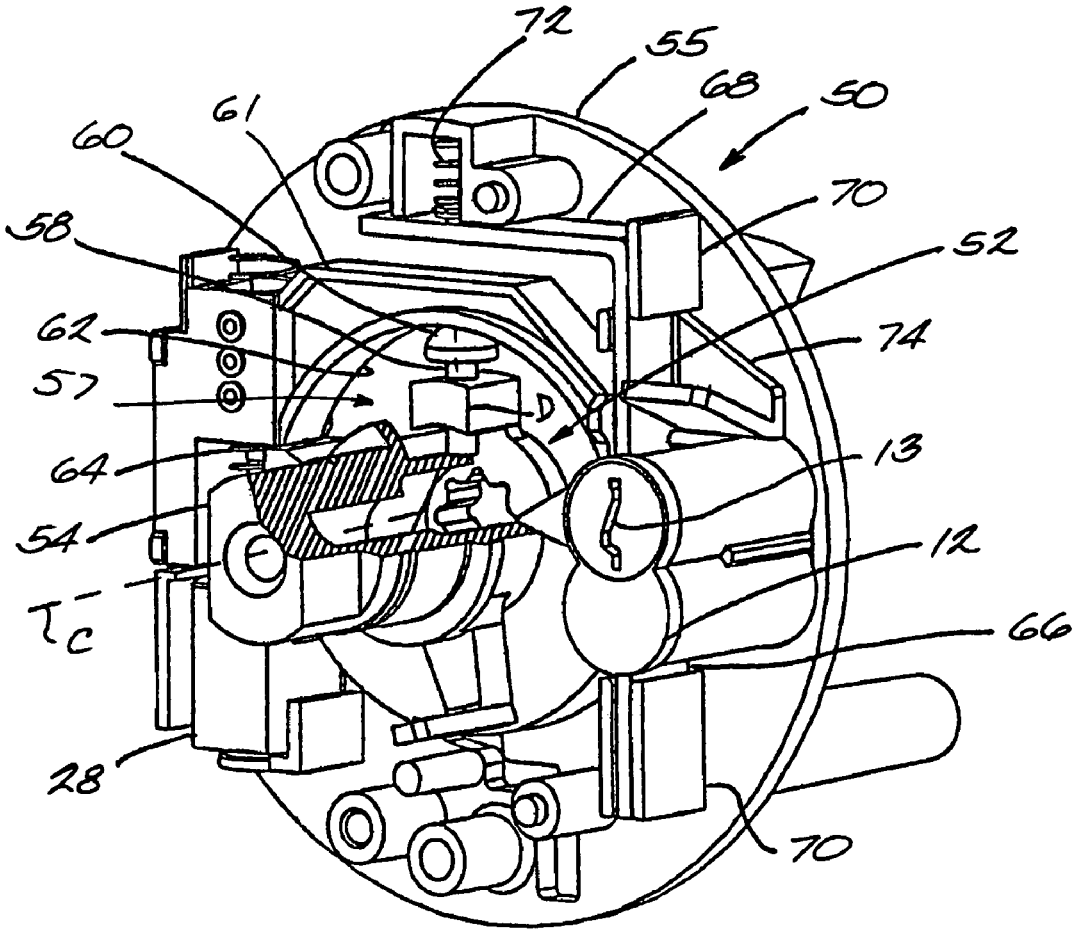
FIG. 7 is a perspective view of the lock system shown in FIG. 5 with the outer housing removed and the lock system in an unlocked position.

As shown in FIGS. 1–4, the lock system 10 includes an interchangeable core 12 (e.g., a Schlage™ interchangeable core cylinder, a Best-type interchangeable core, and like the like), a lever handle 14, a faceplate or cover 15, and a base plate 16. As shown in FIGS. 1–3, the core 12 is mounted in a recess 17 that extends through the bottom edges of the cover 15 and the base plate 16. The interchangeable core 12 is removable (as shown in FIG. 4) so that the lock system 10 can be upgraded and/or re-keyed as needed, thereby eliminating the need to re-pin the lock system 10. To replace the core 12, a control key (not shown) is inserted through a keyway (not shown), which extends through a front face of the core 12. The core 12 is then withdrawn from the recess 17 and a new core 12 is inserted into the recess 17.

The handle 14 is coupled to an input cam 18, which extends through the cover 15 and defines a first axis A. Together, the handle 14 and the input cam 18 are pivotable about the first axis A. An output cam 20 is arranged on an interior side of the cover 15 and is coupled to lockset 21. The output cam 20 defines a second axis B and includes an engagement pin or shaft 22 having an arcuately shaped head 24. Together, the input and output cams 18, 20 operate as a clutch, providing selective operation of the door lock system 10 as described in greater detail below.

The engagement pin 22 is moveable along the second axis B between a first or disengaged position (shown in FIG. 2), in which the engagement pin 22 is spaced a distance from the input cam 18, and a second or engaged position (shown in FIGS. 3 and 4), in which the engagement pin 22 engages the input cam 18. In the illustrated construction, the second axis B is substantially perpendicular to the first axis A. However, one having ordinary skill in the art will appreciate that in other constructions (not shown) the first and second axes A, B can be arranged differently and may or may not intersect. Additionally, in some constructions, the engagement pin 22 is coupled to the handle 14 to pivot about the first axis A in response to pivoting motion of the handle 14.

As shown in FIGS. 2–4, the arcuately shaped head 24 of the engagement pin 22 engages a carriage 27 having an arcuately shaped camming surface 26. The arcuately shaped camming surface 26 is configured to accommodate pivoting movement of the handle 14 and the input cam 18 about the first axis A. More specifically, the camming surface 26 is configured to remain in operational engagement with the output cam 20 as the input cam 18 and the handle 14 pivot about the first axis A. Additionally, the carriage 27 is moveable in a direction substantially parallel to the illustrated second axis B between a first or upward-most position (shown in FIG. 2) and a second or downward-most position to selectively move the engagement pin 22 along the second axis B. As shown in FIG. 2, when the carriage 27 is in the upward-most position, a spring (not shown) biases the engagement pin 22 upwardly along the second axis B away from the input shaft 18. As shown in FIGS. 3 and 4, when the carriage 27 is in the downward-most position, the carriage 27 compresses the spring and forces the engagement pin 22 into mating engagement with the input shaft 18.

As shown in FIGS. 2–4, a motor 28 is coupled to the base plate 16 adjacent to the carriage 27. In the illustrated construction, the motor 28 is a bi-directional DC motor and is powered by batteries 29. However, one having ordinary skill in the art will appreciate that other motors (e.g., AC motors) can also or alternately be used. Additionally, in other constructions (not shown), the motor 28 can be hardwired through the door. In the illustrated construction, the motor 28 includes a shaft 30, which is connected to an axially extending spring 32. The spring 32 engages a drive nut (not shown) coupled to the carriage 27. The spring 32 acts as a worm gear and meshes with the drive nut. In this manner, rotational motion of the motor 28 is converted into axial motion of the carriage 27 along the second axis B. More particularly, as the motor 28 rotates the shaft 30 in a first direction (e.g., clockwise), the interaction between the spring 32 and the drive nut causes the carriage 27 to move downwardly. Similarly, as the motor 28 rotates the shaft 30 in a second direction (e.g., counterclockwise), the interaction between the spring 32 and the drive nut causes the carriage 27 to move upwardly. Additionally, during normal operation, the drive spring 32 compensates for jamming conditions.

As shown in FIG. 1, a keypad 34 is arranged on the cover 15. The keypad 34 is in communication with a controller (not shown) and lights 35. During normal operation, an authorized operator enters an appropriate access code using the keypad 34. If the operator enters an unacceptable access code, the signal lights 35 alert the operator that the signal was unacceptable (e.g., the signal lights 35 emit red light). If the operator enters an acceptable access code, a signal is transmitted to the controller and the signal lights 35 acknowledge entry of an acceptable access code (e.g., the signal lights 35 emit green light). The controller then directs the motor 28 to move the carriage 27 from the upward-most position to the downward-most position. As explained above and as shown in FIGS. 3 and 4, as the carriage 27 moves toward the downward-most position, the carriage 27 moves the engagement pin 22 from the disengaged position (shown in FIG. 2) toward the engaged position (shown in FIG. 3), operably connecting the handle 14 and the input cam 18 with the output cam 20. Once the engagement pin 22 is in the engaged position, the input cam 18 and the output cam 20 are in mating engagement and an operator can open the door by pivoting the handle 14 about the first axis A in a conventional manner.

The position of the carriage 27 is also controlled by an override pusher or frame 36. The frame 36 is a generally U-shaped member having a lower generally horizontal leg 38 and an upper generally horizontal leg 40. The frame 36 is slideably mounted on the interior side of the base plate 16 between mounting tabs 42 for generally vertical sliding movement between a first or neutral position (shown in FIGS. 2 and 3) and a second or override position (shown in FIG. 4). A bias spring 44 is positioned above the upper leg 40 and biases the frame 36 downward toward the override position. As shown in FIGS. 2 and 3, the core 12 engages the lower leg 38 and limits the downward sliding movement of the frame 36.

When the core 12 is removed (as shown in FIG. 4), the bias spring 44 forces the frame 36 downward toward the override position. In the override position, the upper leg 40 of the frame 36 contacts the carriage 26. The upper leg 40 then forces the carriage 27 downward toward the downward-most position (shown in FIG. 4), in which the carriage 27 compresses the engagement pin 22, operably coupling the input and output cams 18, 20.

When electrical power fails and/or when the batteries 29 fail, the motor 28 and/or keypad 34 may be rendered inoperable. However, maintenance personnel and/or emergency workers using a control key can remove the core 12. As explained above, removal of the core 12 allows the bias spring 44 to push the frame 36 downward toward the override position, effectively unlocking the lock system 10 by forming a direct linkage between the handle 14 and the lockset 21. Once the direct linkage between the handle 14 and the lockset 21 is established, an operator can open the door by pivoting the handle 14 about the first axis A in a conventional manner.

FIGS. 5–8 illustrate an alternate construction of a lock system 50 having an electrically operated clutch mechanism 52. Additionally, the door lock system 50 is hardwired and, as shown in the figures, is relatively compact. The lock system 50 is substantially similar in concept to the previously described lock system 10. Therefore, for reasons of clarity and brevity, only differences between the first and second constructions will be described hereafter.

As shown in FIGS. 5–8, the lock system 50 includes a core 12, a handle 14 and a base plate 55. The core 12 includes a keyway 13 and extends through a front face 51 of a generally circular faceplate 53. The handle 14 is coupled to an input cam 54, which defines a first axis C. An output cam 56 is coupled to a lockset 57. Together, the input and output cams 54,56 operate as a clutch, providing selective operation of the door lock system 50, as described below in greater detail.

Selective coupling of the input cam 54 and the output cam 56 is achieved by axial positioning of an engagement pin 58, which includes an arcuately shaped head 60 and defines a second axis D. The engagement pin 58 is moveable along the second axis D between a first or disengaged position (shown in FIG. 6), in which the engagement pin 58 is spaced a distance from the input cam 54, and a second or engaged position (shown in FIGS. 7 and 8), in which the engagement pin 58 engages the input cam 54.

A carriage 61 includes an arcuately shaped camming surface 62 that accommodates pivoting movement of the handle 14 and the input cam 18 about the first axis C. Accordingly, the axial position of the engagement pin 58 can be controlled throughout the pivoting travel range of the handle 14. Additionally, the carriage 61 is moveable axially along the interior surface of the base plate 53 between a first or upward-most position (shown in FIG. 6), in which a spring (not shown) biases the engagement pin 58 toward the disengaged position, and a second or downward-most position (shown in FIGS. 7 and 8), in which the carriage 61 moves the engagement pin 58 toward the engaged position.

The position of the carriage 61 is at least partially a function of a bias provided by motor (e.g., a bi-directional DC motor) 28 mounted on the base plate 55. The motor 28 includes a motor shaft (not shown) and a spring shaft 64 that engages a drive pin (not shown), which is coupled to the carriage 61. More particularly, when the motor 28 rotates the motor shaft in a first direction (e.g., clockwise), the motor 28 moves the carriage 61 toward the upward-most position. Alternatively, when the motor 28 rotates the motor shaft in a second direction (e.g., counterclockwise), the motor 28 moves the carriage 61 toward the downward-most position.

The position of the carriage 61 is also at least partially a function of the override pusher 66. The override pusher 66 is a generally L-shaped body having an upper generally horizontal leg 68. The override pusher 66 is mounted between mounting tabs 70 for generally vertical sliding movement between a first or neutral position (shown in FIGS. 6 and 7) and a second or override position (shown in FIG. 8). A bias spring 72 urges the override pusher downward (e.g., toward the override position) so that a side arm 74 contacts the core 12. Thus, the presence of the core 12 limits the downward sliding movement of the override pusher 66 and maintains the override pusher 66 in the neutral position.

Figure 8:
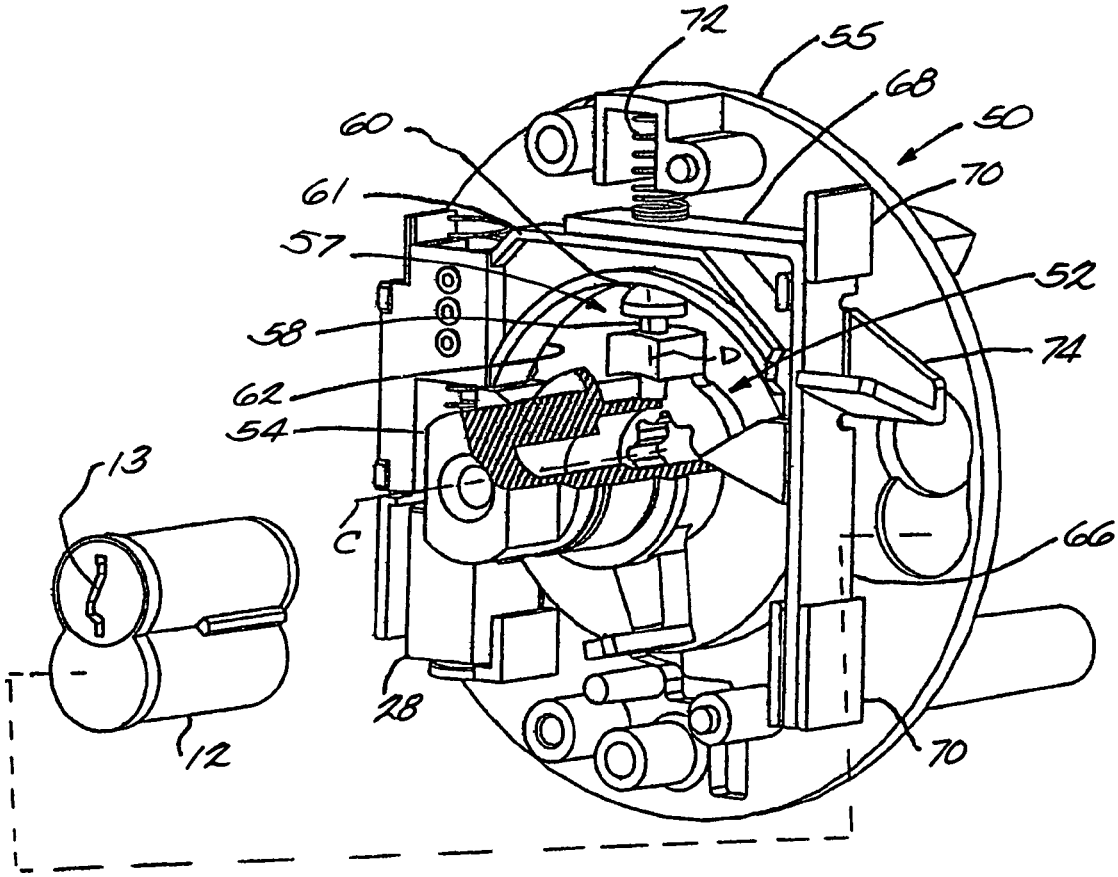
FIG. 8 is a perspective view of the lock system shown in FIG. 5 with the outer housing removed and a lock core removed from the lock system.

When the core 12 is removed, as shown in FIG. 8, the bias spring 72 forces an override pusher or frame 66 downward toward the override position. The frame 66 then moves the carriage 61 toward the downward-most position, causing the engagement pin 58 to move toward the engaged position, which results in a coupling of the input cam 54 and the output cam 56 (as shown in FIG. 8).

Accordingly, during an emergency and/or when the power to the motor 28 is interrupted, an authorized person using a control key can easily remove the core 12. Removal of the core 12 causes downward movement of the frame 66, causing movement of the carriage 61, which effectively unlocks the mechanism 10 by engaging the handle 14 and the input cam 18 with the output cam 20. At all other times, the operation of the lock apparatus 50 is unchanged.

The terms "core" and "interchangeable core" as used herein refer to a wide spectrum of commercially available locking cylinders operated by control keys that allow replacement of the core of a lock system for re-keying purposes. Thus, as used herein and in the appended claims the terms "core" and "interchangeable core" refer to a wide range of components that may be readily interchangeable in various conventional lock devices.

The constructions described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

What is claimed is:

1. A clutch mechanism for a door having a lockset with a lockable latch and actuator for operating the latch, the clutch mechanism comprising:

an input cam;

an output cam;

an engagement pin having an axis and being dimensioned and configured for axial movement between a first position, in which the engagement pin engages both the input cam so that the input cam and output cam rotate synchronously, and a second position, which allows independent rotational movement of the input cam and the output cam;

a movable camming surface cooperating with the engagement pin to move the axial position of the engagement pin between the first position and the second position;

override means biasing the position of the camming surface towards an override position to force the engagement pin to the first position; and a removable interchangeable core, the core when installed blocking the override means from forcing the camming surface toward the override position, the core when not installed allowing the override means to bias the camming surface to the override position;

wherein the override means includes a coil spring.

2. A clutch mechanism for a door having a lockset with a lockable latch and actuator for operating the latch, the clutch mechanism comprising:

an input cam;

an output cam;

an engagement pin having an axis and being dimensioned and configured for axial movement between a first position, in which the engagement pin engages both the input cam so that the input cam and output cam rotate synchronously, and a second position, which allows independent rotational movement of the input cam and the output cam;

a movable camming surface cooperating with the engagement pin to move the axial position of the engagement pin between the first position and the second position;

override means biasing the position of the camming surface towards an override position to force the engagement pin to the first position; and a removable interchangeable core, the core when installed blocking the override means from forcing the camming surface toward the override position, the core when not installed allowing the override means to bias the camming surface to the override position;

wherein the interchangeable core is elongated to define a longitudinal axis parallel to a drive axis.

3. A lock assembly for a door having a latch and an actuator for operating the latch, the lock assembly comprising:

a housing supported by the door;

a first body positioned in the housing and connected to the actuator for movement with the actuator relative to the door;

a second body positioned in the housing and operable to move the latch relative to the door, the second body being movable relative to the first body between a first position, in which the second body engages the first body, and a second position, in which the second body is disengaged from the first body;

a carriage supported in the housing;

a frame at least partially surrounding the carriage;

a core removably supportable on the base and being engageable with the frame; and a spring positioned adjacent to the frame, and wherein, when the core is removed from the base, the spring is operable to move the frame relative to the housing, the carriage into engagement with the second body, and the second body toward the first position;

wherein the frame includes a first end and a second end, and wherein, when the core is supported in the housing, the first end is engageable with the core and the second end is engageable with the carriage.

* * * * *